US005420671A

United States Patent [19]

Kisu et al.

[11] Patent Number: 5,420,671

[45] Date of Patent: May 30, 1995

[54] CHARGER AND IMAGE FORMING APPARATUS WITH SAME

[75] Inventors: Hiroki Kisu, Ichikawa; Toshio Miyamoto, Tokyo; Yohji Tomoyuki, Yokohama; Junji Araya, Yokohama; Shunji Nakamura, Yokohama; Masanobu Saito, Yokohama, all of Japan

[73] Assignee: Canon Kabushiki Kaisha, Tokyo, Japan

[21] Appl. No.: 196,803

[22] Filed: Feb. 15, 1994

Related U.S. Application Data

[63] Continuation of Ser. No. 752,974, Sep. 3, 1991, abandoned, which is a continuation of Ser. No. 338,626, Apr. 17, 1989, abandoned.

[30] Foreign Application Priority Data

Apr. 20, 1988 [JP] Japan ..... 63-97532

[51] Int. Cl.[6] ..... G03G 15/02

[52] U.S. Cl. ..... 355/219; 355/210

[58] Field of Search ..... 355/218, 219, 222, 224, 355/227, 272, 274, 208, 210; 361/225, 221, 235

[56] References Cited

U.S. PATENT DOCUMENTS

| | | | |
|---|---|---|---|
| 2,892,973 | 6/1959 | Straughan | 355/219 X |
| 3,976,881 | 8/1976 | Parker | 250/324 |
| 4,325,627 | 4/1982 | Swidler et al. | 118/661 X |
| 4,727,463 | 2/1988 | Suzuki | 355/219 X |
| 4,728,880 | 3/1988 | Walgrove | 323/267 |
| 4,783,716 | 11/1988 | Nagase et al. | 355/219 X |
| 4,851,960 | 7/1989 | Nakamura et al. | 355/222 X |
| 4,931,838 | 6/1990 | Ban et al. | 355/260 |
| 4,967,231 | 10/1990 | Hosoya et al. | 355/219 |
| 5,144,368 | 9/1992 | Ohzeki et al. | 355/219 |
| 5,229,818 | 7/1993 | Nakahara et al. | 355/219 X |
| 5,272,505 | 12/1993 | Shishido et al. | 355/219 |
| 5,305,177 | 4/1994 | Aoki et al. | 361/225 |

FOREIGN PATENT DOCUMENTS

| | | | |
|---|---|---|---|
| 0280542 | 8/1988 | European Pat. Off. . | |
| 0308185 | 3/1989 | European Pat. Off. | 355/219 |
| 0312230 | 4/1989 | European Pat. Off. | 355/219 |
| 56-126861 | 10/1981 | Japan . | |
| 65-132356 | 10/1981 | Japan . | |
| 0132356 | 10/1981 | Japan . | |
| 0192270 | 10/1984 | Japan . | |
| 59-192270 | 10/1984 | Japan . | |
| 195563 | 10/1985 | Japan . | |
| 62-175779 | 8/1987 | Japan . | |
| 62-175781 | 8/1987 | Japan . | |
| 0175781 | 8/1987 | Japan . | |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

A charging device contactable to a member in order to charge it electrically. The voltage of the charging member includes an AC component. A controller controls the AC component so as to be a constant current, by which the member to be charged can be stably and uniformly charged even if ambient conditions change.

93 Claims, 4 Drawing Sheets

CHARGER AND IMAGE FORMING APPARATUS WITH SAME

This application is a continuation of application Ser. No. 07/752,974 filed Sep. 3, 1991, now abandoned, which was a continuation of application Ser. No. 07/338,626 filed Apr. 17, 1989, now abandoned.

FIELD OF THE INVENTION AND RELATED ART

The present invention relates to a charging device for charging a member to be charged such as a photosensitive member, more particularly to a charger contacted to the member to be charged and supplied externally with a voltage having an AC component.

For the convenience of description, an electrophotographic copying apparatus is taken wherein a photosensitive member is electrically charged.

As is well known, an electrophotographic copying process includes a step of charging the surface of the photosensitive member to a predetermined potential level. As for the means for discharging, almost all of the commercialized machines include a corona discharger mainly constituting of a wire electrode and a shield electrode. The charging system, using the corona discharger, involves the following problems.

(1) High Voltage Application

In order to charge the surface of the photosensitive member up to 500–700V, it is required that a high voltage such as 8–4 KV is applied to the corona wire. The distance between the wire and the electrode has to be large enough to prevent the current leakage to electrode and the main body, and therefore, the corona discharger is bulky, and use of a cable shielded for high insulation is inevitable.

(2) Low Charging Efficiency

Most of the discharge current from the wire flows into the shield electrode, and the corona current flowing to the photosensitive member, that is, the member to be charged is only several percent of the total discharging current.

(3) Corona Discharge Production

The corona discharge produces ozone or the like, which tends to oxidize various parts of the apparatus and to deteriorate the surface of the photosensitive member with the result of lowered resistance of the photosensitive member leading to blurred image (particularly under high humidity conditions).

(4) Wire Contamination

In order to increase the discharge efficiency, a discharge wire is required to have a large curvature (generally it has 60–100 microns diameter). Such a wire collects fine dust by the high voltage field adjacent the wire surface, so that it is contaminated. The contamination tends to produced non-uniform discharge with the result of non-uniform images. This necessitates frequent cleaning of the wire and the discharging device.

Recently, it is considered to use a contact type charging means wherein a charging member is contacted to the member to be charged, without use of the corona discharger involving the above problems.

More particularly, for example, a charging member such as a conductive and elastic roller or the like which is externally supplied with a DC voltage of approximately 1–2 KV, is contacted to the surface of the photosensitive member (the member to be charged), by which the surface of the photosensitive member is charged to a predetermined potential.

On the other hand, the contact type charging device still involves various problems, and it has been proposed in an application which has been assigned to the assignee of this application that in order to solve the problem a vibrating electrode having a peak-to-peak voltage which is not less than twice a charge starting voltage when a DC voltage is applied to the charging member is formed between the charging member and the member to be charged, so that the member to be charged is uniformly charged (U.S. Ser. No. 131,855, now U.S. Pat. No. 4,851,960). In addition, another proposal has been made in U.S. Ser. No. 243,716, now U.S. Pat. No. 5,126,913, in which a high resistance layer is provided as a surface layer of the charging member to prevent current leakage due to pin-holes and damages or the like on the surface of the member to be charged such as a photosensitive member.

However, the provision of the high resistance surface layer of the charging member, causes another problem, since the high-resistance layer of the charging member is easily influenced by ambient conditions, particularly humidity, so that the impedance of the charging member increases due to increase of the resistance and the decrease of the dielectric constant under the low-humidity conditions, whereas under the high-humidity conditions, the impedance of the charging member decreases due to the decrease of the resistance and the increase of the dielectric constant. As a result, under the low humidity conditions, an AC component of the voltage applied from the voltage source is attenuated by the impedance of the charging member with the result that the above-described vibrating electric field and peak-to-peak voltage which is not less than twice the charge starting voltage is not formed between the charging member and the member to be charged, and therefore, that non-uniform charging, more particularly spot-like charging can occur.

Here, it is possible that as a preparation for the attenuation of the AC component due to the impedance of the charging member under the low humidity conditions, a high peak-to-peak AC voltage is applied to the charging member so that the vibrating electric field of a peak-to-peak voltage which is not less than twice the charge starting voltage is formed between the charging member and the member to be charged even under the low humidity conditions.

However, if this is done, the AC component is not attenuated by the charging member under the high humidity conditions which decreases the impedance, so that the high voltage is directly applied to the member to be charged. Therefore, it is disadvantageous with respect to the leakage of the member to be charged and the charging member under the high humidity conditions where the durability properties of the material is reduced generally.

SUMMARY OF THE INVENTION

Accordingly, it is a principal object of the present invention to provide a charging device and an image forming apparatus provided with the charger wherein the member to be charged is charged in good order even under varying ambient conditions.

It is another object of the present invention to provide a charging device and an image forming apparatus provided with the charger wherein the leakage to the member to be charged is prevented so that a uniform and stabilized charging is possible even when the resistance and capacity of the charging member varies due to variation of the ambient conditions.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
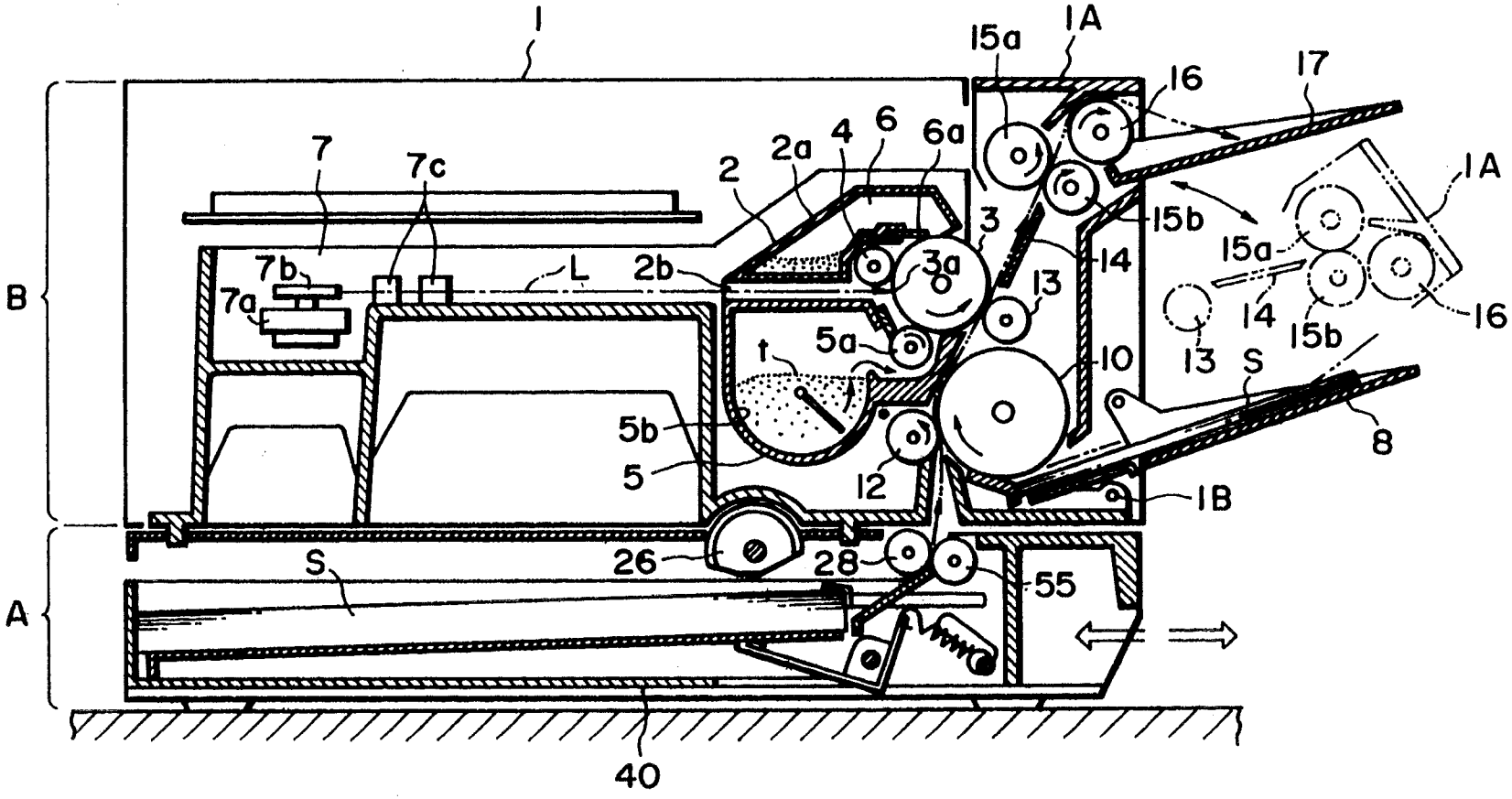
FIG. 1 is a sectional view of a laser beam printer as an exemplary image forming apparatus provided with a charging device according to an embodiment of the present invention.

Referring to FIG. 1, there is shown an image forming apparatus usable with the charging device according to the present invention. The image forming apparatus comprises in combination a sheet feeding station A and a laser beam printer station B.

The printer station B will first be described in structure and the image forming operation. The printer station includes an outer casing 1, and the front side of the apparatus is the right end side in the Figure. The printer B includes a front plate 1A which is openable, as shown by chain lines, about a hinge shaft 1B from the outer casing 1, and is closable, as shown by the solid lines. The front plate 1A is opened to provide wide access to the inside of the printer when a process cartridge 2 is to be mounted into or dismounted from the printer, or when the inside of the printer is to be inspected or serviced.

The process cartridge 2 in this embodiment contains in its cartridge housing 2*a*, a photosensitive drum 3, a charging roller 4, a developing device 5 and a cleaner 6, i.e., four image forming process means. The process cartridge 2 is mounted to or dismounted from a predetermined accommodating portion in the printer outer casing 1, when the front plate 1A is opened as shown by the chain lines. When the cartridge 2 is correctly mounted in the printer, the cartridge and the printer are coupled in the driving system connection and the electrical circuit connection through an unshown coupling member to establish mechanical unity. Although the process cartridge contains the photosensitive drum, the charging roller, the developing device and the cleaner as a unit, the present invention is not limited to the process cartridge containing them, and it may contain as a unit only the photosensitive drum and the charging roller. It will suffice if it contains the photosensitive drum and at least one of the process means contributable to the repeated image formation and if it is detachably mountable into the main assembly of the image forming apparatus.

The apparatus comprises a laser beam scanner 7 adjacent a rear side of the outer casing 1. The laser beam scanner 7 includes a semiconductor laser, a scanner motor 7*a*, a polygonal mirror 7*b* and a lens system 7*c*. A laser beam L from the scanner 7 is directed into the housing 2*a* substantially horizontally through an exposure window 2*b* of the cartridge housing 2*a* which is mounted in the printer. The beam is incident at an exposure position 3*a* to the left side surface of the photosensitive drum 3 along a path between the cleaner 6 and the developing device 5 disposed at upper and lower sides of the housing, so that the surface of the photosensitive drum 3 is scanned and exposed in the direction of its generating line.

The printer further includes a multi-feeding tray 8 which is extended outwardly below the printer front plate 1A. The feeding train is inclined upwardly away from the front plate. Plural sheet materials S can be set thereon.

The printer further comprises a sheet material feeding roller 10 disposed at a lower portion adjacent the inside of the printer front plate 1A, a conveying roller 12 contacted to the left side of the feeding roller 10, an image transfer roller 13 provided on the inside of the printer front plate 1A above the feeding roller 10, a couple of fixing rollers 15*a* and 15*b* mounted on a top part of the inside of the printer front plate 1A, a sheet guiding plate disposed between the transfer roller 13 and the fixing roller couple 15*a* and 15*b*, a sheet material discharging roller disposed at the sheet material outlet of the fixing roller couple 15*a* and 15*b*, and a tray 17 for receiving the sheet materials discharged.

When an image formation start signal is produced in a control system of the printer, the photosensitive drum 3 is rotated at a predetermined peripheral speed in the counterclockwise direction as shown, during which the periphery thereof is uniformly charged to a predetermined positive or negative polarity by the charging roller 4. The charging roller 4 is supplied with a predetermined voltage from a power source to charge the photosensitive drum 3 through a so-called contact charging. The charging roller 4 may be driven by the rotation of the photosensitive drum 3, or it may be positively rotated in the opposite direction. Alternatively, it may be non-rotatable. However, from the standpoint of the wear of the photosensitive drum 3 and the charging roller 4, the charging roller 4 is preferably driven by the photosensitive drum 3 or positively driven at the same peripheral speed as the photosensitive drum 3 at the contact portion therebetween.

Then, in an exposure station, the surface of the rotating photosensitive drum 3 having been uniformly charged is exposed to a picture element laser beam L which corresponds to time-series electric picture element signals indicative of image information produce from the laser beam scanner 7, and the drum 3 surface is sequentially scanned in the direction of the generating line of the drum by the laser beam L, by which an electrostatic latent image of the image information is formed on the surface of the photosensitive drum 3.

The latent image formed on the drum 3 surface is sequentially developed with toner by a developer carried on a developing sleeve (or roller) of the developing device 5. The developing device 5 includes a toner container 5b for containing the developer (toner) t.

A topmost one of the sheet materials (transfer sheets) S set on the multi-feeding tray 8 is introduced into the printer by the feeding roller 10 driven in the direction indicated by an arrow. The sheet material is caught by a nip formed between the feeding roller 10 and the conveying roller 12 and is directed to a transfer station where the photosensitive drum 3 and the transfer roller 13 are opposed or contacted, at the same constant peripheral speed of the photosensitive drum 3.

During the sheet material passing between the photosensitive drum 3 and the transfer roller 13, the toner image is transferred from the photosensitive drum 3 surface onto the sheet material by the voltage applied to the transfer roller 13 (having a polarity opposite to the polarity of the toner) and the pressure-contact force between the transfer roller 13 and the photosensitive drum 3. The voltage application to the transfer roller 13 is effected when a leading edge of the fed sheet material reaches a contact portion (transfer position) between the photosensitive drum 3 and the transfer roller 13.

The sheet material having passed through the transfer station is separated from the surface of the photosensitive drum 3 and is guided along the guiding plate 14, and is introduced into the fixing means including the image fixing rollers 15a and 15b. One 15a of the fixing rollers 15a and 15b is contactable to the image carrying surface of the sheet material and functions as a heating roller containing a halogen heater therein. The other roller 15b is contactable to the backside of the sheet material and functions as a back-up (pressing) roller and is made of an elastic material. The sheet material having received the toner image is passed through the nip between the rollers 15a and 15b, during which the toner image is fixed on the sheet material by heat and pressure, and is discharged as an image carrying product (print) on the tray 17 by the discharging roller 16.

The surface of the photosensitive drum 3, after the toner image is transferred, is cleaned by a cleaning blade 6a of the cleaner 6, so that the residual toner or other contaminations are removed from the drum surface, and is prepared for the repeated image formation.

When a cassette 40 of the sheet material is in place at feeding station A, the topmost one of the sheet materials S in the cassette 40, not a sheet from multi-feeding tray 8, is directed in the direction indicated by an arrow by a pick-up roller 20 to a registration rollers 28 and 55. Then, the sheet material is advanced to between the feeding roller 10 and the conveying roller 12, as described above.

Figure 2:
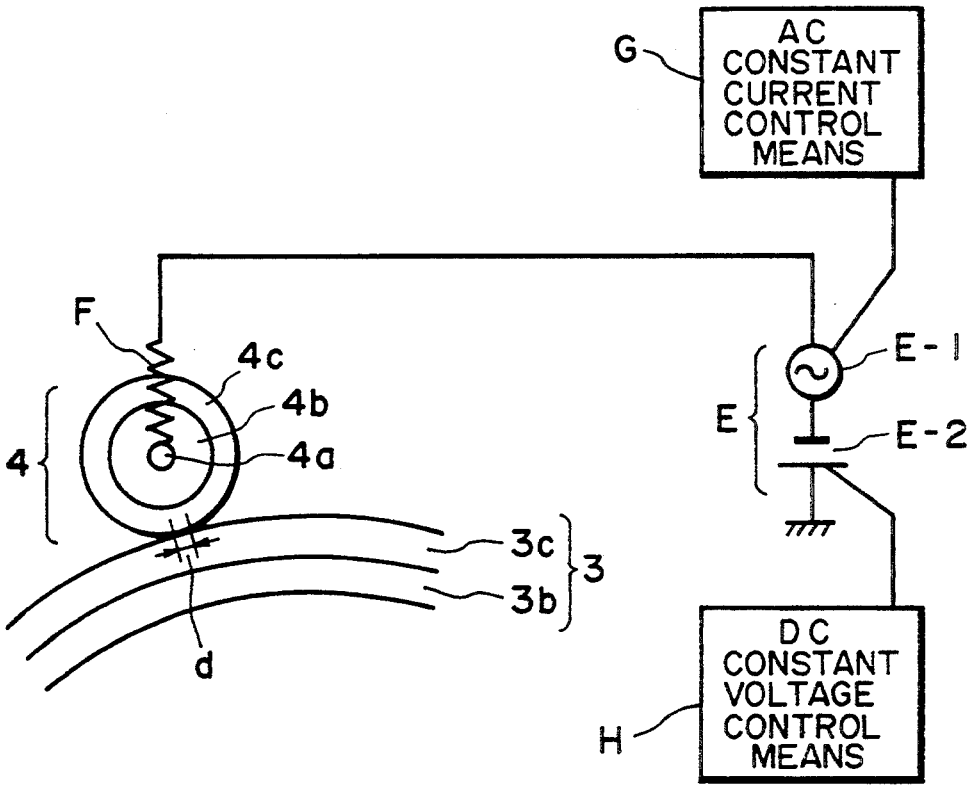
FIG. 2 is a side view of a charging device according to an embodiment of the present invention.

Referring to FIG. 2, the charging device according to an embodiment of the present invention will be described in detail. In this Figure, indicated by a reference numeral 3 is the member to be charged by the charging member 4. The member to be charged includes a base layer 3b made of aluminum or the like, and a photosensitive layer 3c made of an organic photoconductive material, amorphous silicon, selenium or ZnO or the like having a thickness of 20 microns. The charging member 4 functions to uniformly charge the member to be charged to a predetermined potential. The charging member 4 includes a core metal having a diameter of 6 mm, to which a voltage is applied from an external voltage source E through a spring F. The surface of the photosensitive member is charged by a charging member to which the voltage is applied, because electric discharge occurs through a small clearance between the photosensitive member and the charging member. The charging member is contacted to the photosensitive member in order to establish such a fine clearance. More particularly, the fine clearance is maintained by the contact of the charging member to the photosensitive member. The charging member 4 is provided with a high resistance layer 4c to maintain the good charging action even if the member to be charged 3 has flows such as pinholes, through which an excessive current will flaw from the charging member to the member to be charged. In this embodiment, the high resistance layer is made of epichlorohydrin rubber having a volume resistivity of $1.1\times10^8$ ohm.cm. The thickness thereof is 100 microns. Designated by a reference 4b is rubber material such as EPDM impregnated with carbon to lower the resistivity to approximately $1\times10^3$ ohm.cm. It has a thickness of 3 mm. The charging member 4 and the member to be charged 3 are contacted with a contact width d of 1 mm and a contact length measured along the length of the charging member 4 is 220 mm in this embodiment. The electric resistances and the electric capacities of the contact portion were measured under a high temperature and high humidity condition (32.5° C. and 85%, respectively) and under a low temperature and low humidity condition (15° C. and 10%, respectively). They were:

Under high temperature and high humidity condition:

(1) The electric resistance of the charging member $=5.1\times10^5$ ohm.

The electric capacity of the charging member $=2.6\times10^{-10}$ F.

The electric resistance of the charging member $=5.1\times10^9$ ohm.

The electric capacity of the charging member $=1.1\times10^{-10}$ F.

Under low temperature and low humidity condition:

The electric resistance of the charging member $=8.7\times10^6$ ohm.

The electrostatic capacity of the charging member $=1.2\times10^{-10}$ F.

The electric resistance of the charging member $=3.4\times10^{11}$ ohm.

The electrostatic capacity of the charging member $=1.1\times10^{-10}$ F.

The charging member 4 is press-contacted to the charging member 3 by a coil spring F with a total pressure of 1.0 kg. A power source E includes a constant current AC source E-1 in which an AC component is controlled by an AC control current control means G to provide a predetermined current (750 micro-ampere in this embodiment), and a constant voltage DC source E-2 wherein the DC component is at a predetermined voltage level (−750V in this embodiment) by a DC constant voltage control means H. The charge potential of the member to be charged 3 is determined by those voltage sources.

The variation of the impedance at the contact portion between the charging member and the member to be charged is calculated on the basis of the above data, and the results are as shown in the Table below.

TABLE 1

| | high temperature & high humidity (32° C., 85%) | low temperature & low humidity (15° C., 10%) |
|---|---|---|
| charging member | $3.9 \times 10^5$ ohm. | $1.3 \times 10^6$ ohm. |
| member to be charged | $1.4 \times 10^6$ ohm. | $1.4 \times 10^6$ ohm. |

(The frequency of the AC current: 100 Hz)

It is understood that the impedance of the member to be charged does not vary by the ambient condition variation, whereas the impedance of the charging member varies so that it is smaller under the high temperature and humidity conditions and is larger under low temperature and low humidity conditions than under a normal temperature and normal humidity condition (23° C., 64%). Therefore, under the low temperature and low humidity condition, a considerably high voltage is applied to the charging member as contrasted to the high temperature and high humidity condition so that the voltage applied to the member to be charged is substantially decreased. This means that the applied voltage is necessitated to be increased under the low temperature and low humidity condition.

Figure 3:
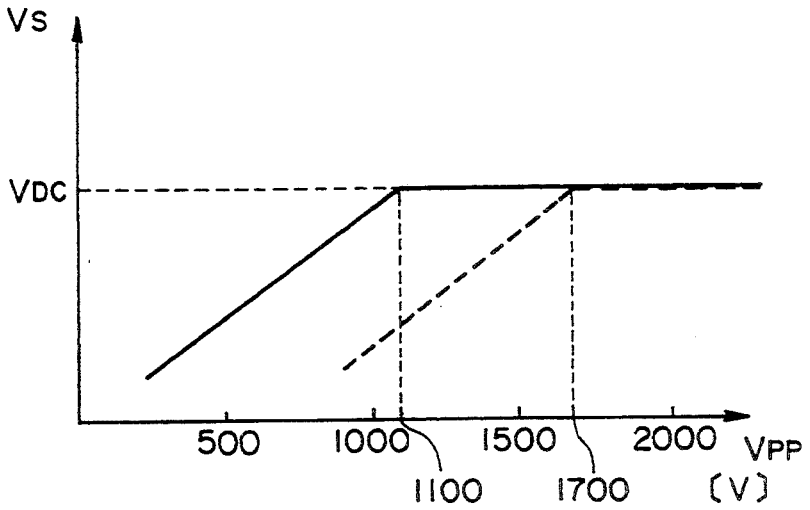
FIG. 3 is a graph showing a relationship between a peak-to-peak voltage Vpp of an AC component applied to the charging member and a surface potential Vs of the member to be charged.

FIG. 3 is a graph of a surface potential (Vs) of the member to be charged when a peak-to-peak voltage (Vpp) of the AC voltage (vibrating voltage) applied to the charging member is changed. The DC component $V_{DC}$ is 750V. As shown in FIG. 3, under the high temperature and high humidity condition (32° C. and 85%), the surface potential of the charged member 3 is stabilized when the peak-to-peak voltage Vpp of the AC component becomes not less than twice (1100 Vpp) the charge starting voltage Vth (approximately 550V), as shown by the solid line. The charge starting voltage is a DC voltage applied to the charging member when the electric charge to the member to be charged starts, as described in U.S. Ser. No. 131,585.

Under the high temperature and high humidity condition, the impedance of the surface layer 4c of the charging member 4 is sufficiently small as compared with that of the member to be charged, and therefore, that component of the AC component of the AC source E-1 which is applied to the charging member is almost negligible so that the AC component is not attenuated by the charging member, and therefore, almost all the AC component is applied to the member to be charged.

As described in U.S. Ser. No. 131,585, when the peak-to-peak voltage Vpp of the AC voltage and the charge starting voltage Vth satisfy the relation of Vpp $\geqq$2Vth, the charging is uniform. This is because, within this range, the electric charge not only transfers from the charging member to the member to be charged, but also transfers back from the member to be charged to the charging member, and therefore, even if the member to be charged receives locally excessive electric charge with the result of high potential, the electric charge transfers back to provide the uniform potential. In other words, the charging is uniform in the solid line of FIG. 3 when the peak-to-peak voltage is not less than 1100 Vpp, whereas if it is lower than 1100 Vpp, the non-uniform charging occurs.

As shown in FIG. 3 by broken line, the plot shifts rightwardly under the low temperature and low humidity condition (15° C. 10%) In this condition, the impedance of the surface layer 4c of the charging member is increased so that the attenuation of the applied AC component is increased. In order to provide a stabilized voltage on the member to be charged 1, it is considered that the voltage not less than 1700 Vpp is required since otherwise the charging becomes non-uniform. However, if the charging device with this setting is placed under the high temperature and high humidity condition, the impedance of the charging member decreases, and therefore, not less than 1.3 mm ampere of AC current flows. Such a large current is a cause of production of pinholes of the member to be charged 3 by dielectric breakdown.

Figure 4:
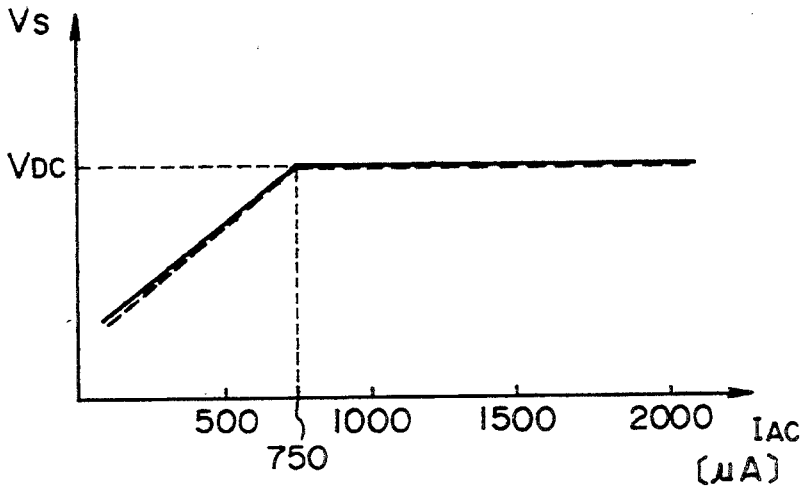
FIG. 4 is a graph showing a relationship between an AC current $I_{AC}$ and the surface potential Vs of the member to be charged.

Referring to FIG. 4, the investigations are made as to the relationship between the surface potential Vs of the member to be charged and the AC current $I_{AC}$ (effective current). The solid line indicates the relation under the high temperature and high humidity condition (32° C., 85%), and the broken line indicates the relation under the low temperature and low humidity condition (15° C., 10%). It is understood that the voltage Vs is stabilized when the AC current is not less than 750 micro-amperes. This is when the frequency of the AC is 1000 Hz. The AC current of 750 micro-amperes at this time is called a threshold Ith. The requirement for the stabilization of the surface potential of the member to be charged is $$I_{AC} \geqq Ith \ (=750 \ micro\text{-}amperes)$$

The reason for this is considered to be because in order to make the surface potential of the member to be charged 3 uniform, a current density over a predetermined is required. It is supposed that the current of 750 micro-amperes is the minimum current required. As will be understood from this Figure, the potential Vs is stabilized under any ambient conditions if the current not less than Ith flows through this system. The value of the current Ith is a value determined depending on the materials of the charging member and the member to be charged and the frequency of an AC voltage applied to the charging member.

Accordingly, it is considered that the surface potential of the charged member 3 is always stabilized if a constant current not less than 750 micro-amperes is supplied from the AC voltage source. Therefore, the AC component was controlled to provide a constant current (750 micro-amperes), and the peak-to-peak voltage Vpp of the AC component was investigated. It was 1150 Vpp under the high temperature and high humidity condition, and 2000 Vpp under low temperature and low humidity condition (15° C., 10%). It is understood that the impedance of the charging member 4 decreases under the high temperature and high humidity condition, and therefore, the peak-to-peak voltage of the AC component required for providing 750 micro-amperes is as small as 1150 Vpp, whereas under the low temperature and low humidity condition, the impedance of the charging member 4 increases, and therefore, 2000 Vpp is required to provide the same 750 micro-amperes. Referring back to FIG. 3, the charging is uniform when the peak-to-peak voltage is not less than 1100 Vpp on the solid line (high temperature and high humidity condition), and when it is not less than 1700 Vpp on the broken line (low temperature and low humidity condition); and therefore the above is satisfied. By this constant current control for the AC component, the necessity for the constant voltage control, that is, 2000 Vpp of the peak-to-peak voltage is eliminated, which has been necessitated due to the decrease of the charging capacity to the member to be charged 3 because of the attenuation of the AC component by the increased impedance of the surface layer 4C of the charging member 4 under the low temperature and low humidity condition. That is, even if the impedance of the surface layer 4c of the charging member is reduced under the high temperature and high humidity condition, the AC voltage applied is decreased, and therefore, the member to be charged is not supplied with a high voltage, whereby the production of the pinholes of the member 3 is reduced. Under the low temperature and low humidity condition, with which the impedance of the charging member surface layer 4c increases, the voltage applied is increased, so that even if the voltage is attenuated by the charging member, it becomes possible to maintain the charging power of the charging member 4 is maintained constant.

The DC source E-2 used with the constant current AC source E-1 is a constant voltage source for the following reasons:

When various electrostatic latent image patterns are formed on the member to be charged 3, a certain degree of charge memory corresponding to the pattern remains on the member to be charged 3. In other words, there are charged portions and non-charged portions in the memory of the member to be charged 3. This memory can be erased by a discharging operation, that is, a charge removing operation to the member to be charged, before the charging action, more particularly, by the uniform exposure to light before the charging action when the member 3 is a photosensitive member. However, after it is repeatedly used, the memory in the member 3 becomes not completely removed. If the DC source is a constant current source, the same current flows through the charged and uncharged portion of the member to be charged 3 when the member 3 is re-charged by the charging member 4 after image forming operation. Therefore, the same amount of electric charge is added. Thus, during the next image formation, the non-uniformity occurs between the portion having been charged and the portion not having been charged. As a result, the problems are expected such as the foggy background of the image and the change of the image density.

Figure 5:
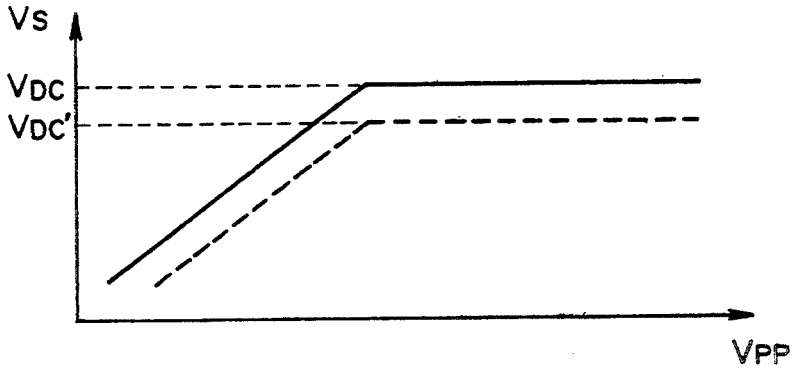
FIG. 5 is a graph showing a relationship between a peak-to-peak voltage Vpp of an AC component applied to the charging member and a surface potential Vs of the member to be charged.

Referring to FIG. 5, there is shown a relation between the peak-to-peak voltage of the AC source applied to the charging member and the surface potential of the member to be charged. As will be understood from this graph, when the DC voltage applied to the charging member is shifted from $V_{DC}$ to $V_{DC}'$, the charge saturation level of the member 3 is also shifted from $V_{DC}$ to $V_{DC}'$. Therefore, the charge saturation level of the member to be charged is determined by the DC voltage applied to the charging member.

Therefore, the DC source for the charging member is preferably a constant voltage source.

Particularly when a laser beam printer shown in FIG. 1 or an LED printer is used, and the same format is repeatedly printed, the pattern of the format is memorized on the photosensitive member (the member to be charged), with the result that even after a different format is printed, the previous format pattern lightly appears on the print. Therefore, the DC voltage applied to the charging member is constant-voltage-controlled, rather than being constant-current-controlled, particularly in such printers.

In a reverse-development, toner particles having the same polarity as the charging property of the photosensitive member (the member to be charged) are deposited on such a portion of the photosensitive member as has a lower potential (light portion of the electrostatic latent image). With the reverse-development, when the toner image on the photosensitive member is transferred onto the transfer material, the transfer means such as a transfer corona discharger or a transfer roller has to be supplied with a voltage having a polarity opposite to the charging property of the photosensitive member. When the charge having the polarity opposite to the charging property of the photosensitive member is applied to the photosensitive member, the photosensitive member sometimes can not be electrically discharged. As a result, the image formed thereafter involves non-uniform image density due to the potential difference if the photosensitive member has been supplied with different electric charge by the charging means, particularly if there has been a potential difference between the portion of the photosensitive member covered by the transfer sheet and the portion not covered by the transfer sheet. Therefore, when the developing system is a reverse-development, the DC voltage applied to the charging member is a constant voltage rather than a constant DC current.

Figure 7:
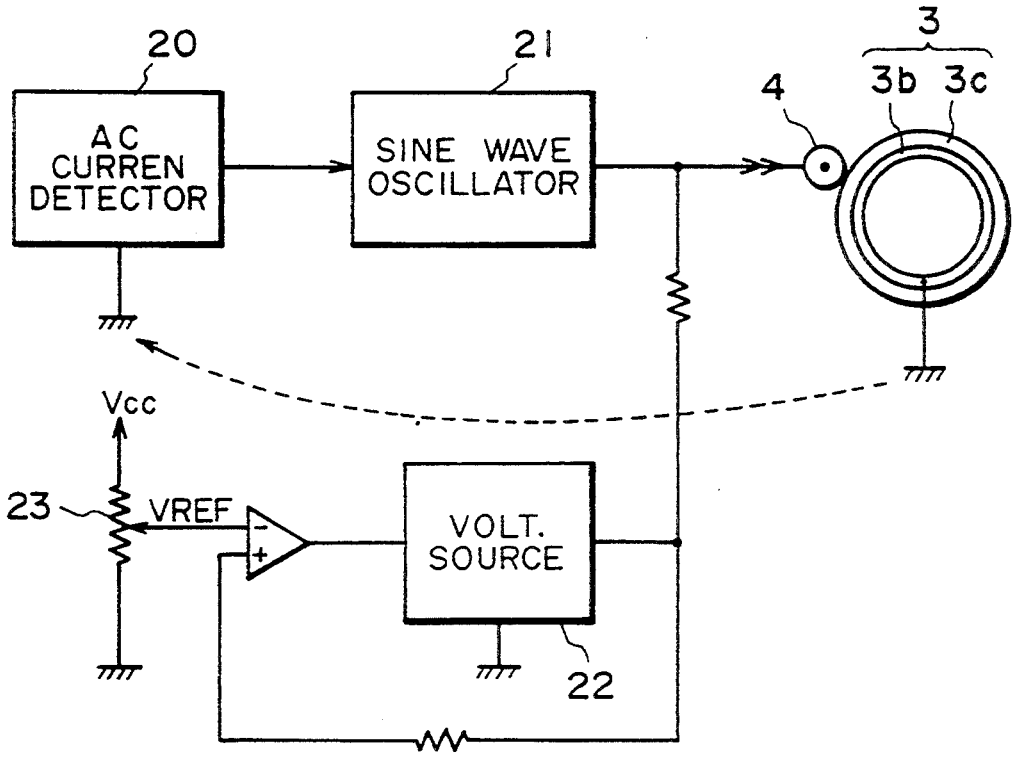
FIG. 7 illustrates a system wherein an AC component of the voltage applied to the charging member is controlled for constant current, and a DC component is controlled for a constant current.

Referring to FIG. 7, there is shown a system for providing a constant current DC component and a constant voltage DC component when a superposed voltage of an AC voltage and a DC voltage is applied to the charging roller 4. The AC current applied to the charging roller 4 flows into an AC current detector 20 through a base layer 3b of the photosensitive drum 3 which is grounded. The AC current detector 20 detects the AC current, and in response thereto, an amplitude of a sine wave from a sine oscillator circuit 21 is controlled to provide a constant amplitude, thus providing a constant current control. In a DC voltage generator 22, the output voltage is fed back, and it is compared with a reference voltage Vref set by an image density adjusting dial for adjusting the image density of the image, thus providing a constant voltage control. The DC voltage generated by the DC generator 22 is superposed to the sine wave generated by the sine wave oscillator circuit, and the superposed voltage is applied to the charging roller 4.

Figure 6:
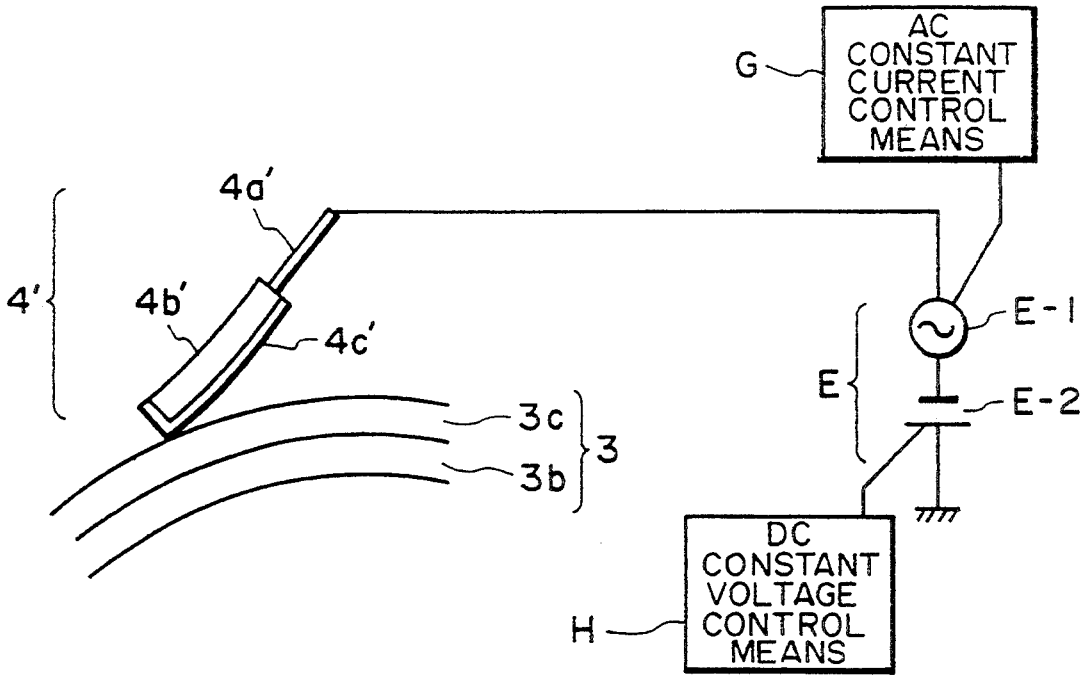
FIG. 6 is a side view of the charging device according to another embodiment of the present invention.

Referring to FIG. 6, there is shown another embodiment, wherein a charging blade 4' is used in place of the charging roller in the foregoing embodiment. The blade is made of a blade body 4b' made of urethane rubber, NBR, EPDM or the like, which is coated with a surface layer 4c made of Torezin (trade name of N-methoxymethyl nylon, available from Teikoku Kagaku Sangyo Kabushiki Kaisha, Japan), NBR, epichlorohydrin rubber or the like. The same advantageous effects are provided with this embodiment. In the Figure, designated by a reference 4a' is a supporting plate made of metal, to which a voltage is supplied from a power source E comprising an AC source E-1 controlled to provide a constant current by an AC constant current control means G and a DC source E-2 controlled to provide a predetermined voltage by a DC constant voltage control means H.

The charging member may be in the form of a brush or belt or the like as well as the roller or the blade described above.

The polarity of the DC source E-2 is matched with the charging property of the member to be charged, if it has the charging property. If not, it may be positive or negative. The waveform of the AC voltage provided by the AC source E-1 may be in the form of a sine wave, a rectangular wave or triangular wave or other waveform. It is possible to use a pulse wave. What is required is to have a vibrating component, that is, a component which is periodically changes with time.

The charging member of the present invention is not limited to those used for forming an electrostatic latent image on the photosensitive member (the member to be charged), but is usable as the image transfer means such as a transfer roller or belt for transferring the toner image from the photosensitive member to the transfer material.

The charging member having been described here is used to provide a predetermined potential on the member to be charged, and therefore, is not limited to apply electric charge to the member, but it may be used for electrically discharging the member.

The member to be charged is not limited to a photosensitive member or drum, but may be a dielectric material drum.

As described in the foregoing, according to the present invention, a voltage having an AC component and a DC component is applied to the charging member contacted to the member to be charged, and therefore, the surface potential of the member to be charged become uniform. By controlling the AC component to provide a constant current, the current leakage to the member to be charged which can occur when the impedance of the charging member changes due to the variation in the ambient conditions, can be prevented, so that the charging operation is stabilized.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

image forming means for forming an image on said image bearing member, said image forming means including latent image forming means for forming a latent image having charging means contactable to said image bearing member for directly charging said image bearing member, and developing means for developing the latent image with toner;

voltage application means for applying a voltage having a periodically vibrating component and a DC component between said charging means and said image bearing member; and control means for controlling the vibrating component applied to said charging means by said voltage application means to a constant current during the formation of the latent image by said latent image forming means.

2. An apparatus according to claim 1, wherein said apparatus further comprises second control means for controlling the DC component applied to the charging means by said voltage application means to a constant voltage.

3. An apparatus according to claim 1, wherein the vibrating component is in the form of a sine wave.

4. An apparatus according to claim 1, wherein the vibrating component is in the form of a triangular wave.

5. An apparatus according to claim 1, wherein the vibrating component is in the form of a rectangular wave.

6. An apparatus according to claim 1, wherein the voltage applied to the charging means includes the vibrating component which has a peak-to-peak voltage larger than twice an absolute value of a charge starting voltage applied to said charging means.

7. An apparatus according to claim 1, wherein said charging means includes a roller.

8. An apparatus according to claim 1, wherein said charging means includes a blade.

9. An apparatus according to claim 1, wherein said image bearing member is a photosensitive member.

10. An apparatus according to claim 1, wherein a polarity to which said image bearing member is charged by said charging means is the same as a polarity of the charge of the toner supplied by said developing means.

11. An apparatus according to claim 9, wherein said latent image forming means includes exposure means for exposing to light a surface of said image bearing member having been charged by said charging means, and said exposure means applies to said image bearing member light corresponding to a signal indicative of image information.

12. An apparatus according to claim 11, wherein said exposure means includes a laser beam scanner.

13. An apparatus according to claim 1, further comprising a process cartridge detachably mounted thereto, said processing cartridge containing said image bearing member and said charging means.

14. An apparatus according to claim 13, wherein said process cartridge further contains developing means for developing the latent image.

15. An apparatus according to claim 1, wherein said charging means includes a core member, a conductive layer, and a resistance layer having a volume resistivity higher than that of said conductive layer, in the order named toward said image bearing member.

16. An apparatus according to claim 1 or 15, wherein said charging means has an impedance which changes with ambient condition.

17. An apparatus according to claim 16, wherein the ambient condition includes ambient temperature and humidity.

18. An apparatus according to claim 1, wherein said vibrating component is in the form of pulses.

19. An apparatus according to claim 9, wherein said image bearing member is of amorphous silicon photoconductor.

20. An apparatus according to claim 9, wherein said image bearing member is of an organic photoconductor.

21. An apparatus according to claim 1, wherein said apparatus has a process cartridge having said image bearing member, said charging means, and said developing means as a unit.

22. An apparatus according to claim 1, wherein said control means controls the voltage having a peak-to-peak voltage level which increases with increase of an impedance of said charging means.

23. An image forming apparatus, comprising:

a movable image bearing member;

image forming means for forming an image on said image bearing member, said image forming means including latent image forming means for forming a latent image, having charging means contactable to said image bearing member for directly charging said image bearing member, and developing means for developing the latent image with toner;

voltage application means for applying a voltage having a periodically vibrating component and a DC component between said charging means and the image bearing member; and control means for controlling said voltage application means so that the voltage has a first peak-to-peak voltage level when said charging means has a first impedance and that the voltage has a second peak-to-peak voltage which is larger than the first voltage level when said charging means has a second impedance which is higher than the first impedance, said control means controls the voltage application means during the formation of the latent image by said latent image forming means.

24. An apparatus according to claim 23, wherein said control means controls the voltage having a peak-to-peak voltage level which increases with increase of an impedance of said charging means.

25. An apparatus according to claim 23, wherein said apparatus further comprises second control means for controlling the DC component applied to the charging means by said voltage application means to a constant voltage.

26. An apparatus according to claim 23, wherein the vibrating component is in the form of a sine wave.

27. An apparatus according to claim 23, wherein the voltage applied to the charging means includes the vibrating component which has a peak-to-peak voltage larger than twice an absolute value of a charge starting voltage to the image bearing member.

28. An apparatus according to claim 23, when said charging means includes a roller.

29. An apparatus according to claim 23, wherein said charging means includes a blade.

30. An apparatus according to claim 23, wherein the image bearing member is a photosensitive member.

31. An apparatus according to claim 23, wherein said charging means includes a core member, a conductive layer, and a resistance layer having a volume resistivity higher than that of said conductive layer, in the order named toward said image bearing member.

32. An apparatus according to claim 23 or 31, wherein said charging means has an impedance which changes with ambient condition.

33. An apparatus according to claim 32, wherein the ambient condition includes ambient temperature and humidity.

34. An apparatus according to claim 23, wherein said vibrating component is in the form of pulses.

35. An apparatus according to claim 22, further comprising a process cartridge detachably mounted thereto, and wherein said process cartridge contains said image bearing member and said charging means.

36. An apparatus according to claim 35, wherein said process cartridge further contains developing means for developing the latent image.

37. An apparatus according to any one of claims 6 or 27, wherein the vibratory component has a peak-to-peak voltage not less than twice an absolute value of the charge starting voltage irrespective of change of an impedance of said charging means.

38. An image forming apparatus, comprising:

a movable image bearing member;

image forming means for forming an image on said image bearing member, said image forming means including latent image forming means for forming a latent image, wherein said latent image forming means includes charging means contactable to said image bearing member to charge said image bearing member;

voltage application means for applying a voltage having a vibrating component between said charging means and said image bearing member; and control means for controlling the vibrating component to a constant current during the formation of the latent image by said latent image forming means.

39. An apparatus according to claim 38, wherein the voltage has a non-vibrating component, and said apparatus further comprises second control means for controlling the non-vibrating component applied to the charging means by said voltage application means to a constant voltage.

40. An apparatus according to claim 38, wherein the vibrating component is in the form of a sine wave.

41. An apparatus according to claim 38, wherein the vibrating component is in the form of a rectangular wave.

42. An apparatus according to claim 38, wherein the vibrating component has a peak-to-peak voltage larger than twice an absolute value of a charge starting voltage applied to said charging means.

43. An apparatus according to claim 38, wherein said charging means is in the form of a roller.

44. An apparatus according to claim 38, wherein said charging means is in the form of a blade.

45. An apparatus according to claim 38, wherein said image bearing member is a photosensitive member.

46. An apparatus according to claim 38, wherein said apparatus comprises developing means for developing the latent image with toner, wherein a polarity to which said image bearing member is charged by said charging means is the same as a polarity of the charge of the toner supplied to said developing means.

47. An apparatus according to claim 46, further comprising a process cartridge detachably mounted thereto, said processing cartridge containing said image bearing member, said charging means, and said developing means.

48. An apparatus according to claim 38, wherein said charging means includes a core member, a conductive layer, and a resistance layer having a volume resistivity higher than that of said conductive layer, in the order named toward said image bearing member.

49. An apparatus according to claim 38, wherein said apparatus has a process cartridge detachably mountable to said apparatus, and said process cartridge contains said image bearing member and said charging member.

50. An apparatus according to claim 38, wherein said control means controls the voltage having a peak-to-peak voltage level with increases with increase of an impedance of said charging means.

51. An apparatus according to claim 38, wherein a waveform of the vibrating component remains unchanged despite change of the impedance of said charging means.

52. An image forming apparatus, comprising:

a movable image bearing member;

image forming means for forming an image on said image bearing member, said image forming means including latent image forming means for forming a latent image, wherein said latent image forming means includes charging means contactable to said image bearing member to charge said image bearing member;

voltage application means for applying a voltage having a vibrating component between said charging means and the image bearing member; and control means for controlling said voltage application means so that the voltage has a first peak-to-peak voltage level when said charging means has a first impedance and that the voltage has a second peak-to-peak voltage which is larger than the first voltage level when said charging means has a second impedance which is higher than the first impedance, said control means controls the voltage application means during the formation of the latent image by said latent image forming means.

53. An apparatus according to claim 52, wherein the voltage has a non-vibrating component, and said apparatus further comprises second control means for controlling the non-vibrating component applied to the charging means by said voltage application means to a constant voltage.

54. An apparatus according to claim 52, wherein the vibrating component is in the form of a sine wave.

55. An apparatus according to claim 52, wherein the vibrating component is in the form of a rectangular wave.

56. An apparatus according to claim 52, wherein the vibrating component has a peak-to-peak voltage larger than twice an absolute value of a charge starting voltage applied to said charging means.

57. An apparatus according to claim 52, wherein said charging means is in the form of a roller.

58. An apparatus according to claim 52, wherein said charging means is in the form of a blade.

59. An apparatus according to claim 52, wherein said image bearing member is a photosensitive member.

60. An apparatus according to claim 52, wherein said apparatus comprises developing means for developing the latent image with toner, wherein a polarity to which said image bearing member is charged by said charging means is the same as a polarity of the charge of the toner supplied to said developing means.

61. An apparatus according to claim 60, further comprising a process cartridge detachably mounted thereto, said processing cartridge containing said image bearing member, said charging means, and said developing means.

62. An apparatus according to claim 52, wherein said charging means includes a core member, a conductive layer, and a resistance layer having a volume resistivity higher than that of said conductive layer, in the order named toward said image bearing member.

63. An apparatus according to claim 52, wherein said apparatus has a process cartridge detachably mountable to said apparatus, and said process cartridge contains said image bearing member and said charging member.

64. An apparatus according to claim 52, wherein said control means controls the voltage having a peak-to-peak voltage level with increases with increase of an impedance of said charging means.

65. An apparatus according to claim 52, wherein a waveform of the vibrating component remains unchanged despite change of the impedance of said charging means.

66. An image forming apparatus, comprising:

a movable image bearing member;

image forming means for forming an image on said image bearing member, said image forming means including latent image forming means for forming a latent image, wherein said latent image forming means includes charging means contactable to said image bearing member, for charging said image bearing member, at a portion of the image bearing member which is adjacent to a contact portion between said charging member and said image bearing member;

voltage application means for applying a voltage having a vibrating component between said charging means and said image bearing member; and control means for controlling the vibrating component to a constant current during the formation of the latent image by said latent image forming means.

67. An apparatus according to claim 66, wherein the voltage has a non-vibrating component, and said apparatus further comprises second control means for controlling the non-vibrating component applied to the charging means by said voltage application means to a constant voltage.

68. An apparatus according to claim 66, wherein the vibrating component is in the form of a sine wave.

69. An apparatus according to claim 66, wherein the vibrating component is in the form of a rectangular wave.

70. An apparatus according to claim 66, wherein the vibrating component has a peak-to-peak voltage larger than twice an absolute value of a charge starting voltage applied to said charging means.

71. An apparatus according to claim 66, wherein said charging means is in the form of a roller.

72. An apparatus according to claim 66, wherein said charging means is in the form of a blade.

73. An apparatus according to claim 66, wherein said image bearing member is a photosensitive member.

74. An apparatus according to claim 66, wherein said apparatus comprises developing means for developing the latent image with toner, wherein a polarity to which said image bearing member is charged by said charging means is the same as a polarity of the charge of the toner supplied to said developing means.

75. An apparatus according to claim 74, further comprising a process cartridge detachably mounted thereto, said processing cartridge containing said image bearing member, said charging means, and said developing means.

76. An apparatus according to claim 66, wherein said charging means includes a core member, a conductive layer, and a resistance layer having a volume resistivity higher than that of said conductive layer, in the order named toward said image bearing member.

77. An apparatus according to claim 66, wherein said apparatus has a process cartridge detachably mountable to said apparatus, and said process cartridge contains said image bearing member and said charging member.

78. An apparatus according to claim 66, wherein said control means controls the voltage having a peak-to-peak voltage level with increases with increase of an impedance of said charging means.

79. An apparatus according to claim 66, wherein a waveform of the vibrating component remains unchanged despite change of the impedance of said charging means.

80. An image forming apparatus, comprising:

a movable image bearing member;

image forming means for forming an image on said image bearing member, said image forming means including latent image forming means for forming to latent image, wherein said latent image forming means includes charging means, contactable to said image bearing member, for charging said image bearing member at a portion of the image bearing member which is adjacent to a contact portion between said charging member and said image bearing member;

voltage application means for applying a voltage having a vibrating component between said charging means and the image bearing member; and control means for controlling said voltage application means so that the voltage has a first peak-to-peak voltage level when said charging means has a first impedance and that the voltage has a second peak-to-peak voltage which is larger than the first voltage level when said charging means has a second impedance which is higher than the first impedance, said control means controls the voltage application means during the formation of the latent image by said latent image forming means.

81. An apparatus according to claim 80, wherein the voltage has a non-vibrating component, and said apparatus further comprises second control means for controlling the non-vibrating component applied to the charging means by said voltage application means to a constant voltage.

82. An apparatus according to claim 80, wherein the vibrating component is in the form of a sine wave.

83. An apparatus according to claim 80, wherein the vibrating component is in the form of a rectangular wave.

84. An apparatus according to claim 80, wherein the vibrating component has a peak-to-peak voltage larger than twice an absolute value of a charge starting voltage applied to said charging means.

85. An apparatus according to claim 80, wherein said charging means is in the form of a roller.

86. An apparatus according to claim 80, wherein said charging means is in the form of a blade.

87. An apparatus according to claim 80, wherein said image bearing member is a photosensitive member.

88. An apparatus according to claim 80, wherein said apparatus comprises developing means for developing the latent image with toner, wherein a polarity to which said image bearing member is charged by said charging means is the same as a polarity of the charge of the toner supplied to said developing means.

89. An apparatus according to claim 88, further comprising a process cartridge detachably mounted thereto, said processing cartridge containing said image bearing member, said charging means, and said developing means.

90. An apparatus according to claim 80, wherein said charging means includes a core member, a conductive layer, and a resistance layer having a volume resistivity higher than that of said conductive layer, in the order named toward said image bearing member.

91. An apparatus according to claim 80, wherein said apparatus has a process cartridge detachably mountable to said apparatus, and said process cartridge contains said image bearing member and said charging member.

92. An apparatus according to claim 80, wherein said control means controls the voltage having a peak-to-peak voltage level with increases with increase of an impedance of said charging means.

93. An apparatus according to claim 80, wherein a waveform of the vibrating component remains unchanged despite change of the impedance of said charging means.

* * * * *

UNITED STATES PATENT AND TRADEMARK OFFICE

CERTIFICATE OF CORRECTION

PATENT NO. : 5,420,671

DATED : May 30, 1995

INVENTOR(S) : Kisu, et al.

It is certified that error appears in the above-identified patent and that said Letters Patent is hereby corrected as shown below:

ON THE TITLE PAGE:

Under [56] References Cited Foreign Patent Documents, "65-132356 10/1981 Japan" should read --56-132356 10/1981 Japan--

"195563 10/1985 Japan" should read --60-195563 10/1985 Japan--

"0132356 10/1981 Japan
0192270 10/1984 Japan
0175781 8/1987 Japan" should be deleted.

IN THE FIGURES

Figure 6, sheet 4, "CURREN" should read --CURRENT--.

IN COLUMN 2

Line 12, "U.S. Ser. No. 131,855," should read --U.S. Ser. No. 131,585,--.

COLUMN 6

Line 14, "flaw" should read --flow--.

COLUMN 13

Line 48, "claim 22," should read --claim 23,--.

UNITED STATES PATENT AND TRADEMARK OFFICE

CERTIFICATE OF CORRECTION

PATENT NO. : 5,420,671

DATED : May 30, 1995

INVENTOR(S) : Kisu, et al.

It is certified that error appears in the above-identified patent and that said Letters Patent is hereby corrected as shown below:

COLUMN 14

Line 51, "with" (first occurrence) should read --which--.

COLUMN 15

Line 54, "with" (first occurrence) should read --which--.

COLUMN 18

Line 27, "with" (first occurrence) should read --which--.

Signed and Sealed this

Sixteenth Day of January, 1996

Bruce Lehman

*Attest:*

BRUCE LEHMAN

*Attesting Officer*

*Commissioner of Patents and Trademarks*